US011274543B2

(12) United States Patent
Chen et al.

(10) Patent No.: US 11,274,543 B2
(45) Date of Patent: Mar. 15, 2022

(54) METHOD FOR ACCURATELY MEASURING REOPENING PRESSURE OF HYDRAULIC FRACTURING INDUCED FRACTURE IN DEEP BOREHOLE

(71) Applicant: Institute of Geomechanics, Chinese Academy of Geological Sciences, Beijing (CN)

(72) Inventors: Qunce Chen, Beijing (CN); Chongyuan Zhang, Beijing (CN); Dongsheng Sun, Beijing (CN); Xianghui Qin, Beijing (CN); Wen Meng, Beijing (CN); Quan Li, Beijing (CN); Ming Jin, Beijing (CN)

(73) Assignee: Institute of Geomechanics, Chinese Academy of Geological Sciences, Beijing (CN)

( * ) Notice: Subject to any disclaimer, the term of this patent is extended or adjusted under 35 U.S.C. 154(b) by 158 days.

(21) Appl. No.: 16/503,995

(22) Filed: Jul. 5, 2019

(65) Prior Publication Data

US 2020/0332647 A1 Oct. 22, 2020

(30) Foreign Application Priority Data

Apr. 16, 2019 (CN) ..... 201910304075.1

(51) Int. Cl.

| | |
|---|---|
| ***E21B 43/26*** | (2006.01) |
| ***E21B 47/06*** | (2012.01) |
| ***E21B 49/00*** | (2006.01) |

(52) U.S. Cl.

CPC ..... *E21B 47/06* (2013.01); *E21B 43/26* (2013.01); *E21B 49/008* (2013.01)

(58) Field of Classification Search

CPC ..... E21B 43/26; E21B 47/06; E21B 49/005–008; E21B 27/02; E21B 33/138; E21B 34/06

See application file for complete search history.

(56) References Cited

U.S. PATENT DOCUMENTS

| | | | | |
|---|---|---|---|---|
| 2011/0284232 | A1* | 11/2011 | Huang | E21B 34/06 166/317 |
| 2013/0180722 | A1* | 7/2013 | Olarte Caro | E21B 43/162 166/308.1 |
| 2017/0241595 | A1* | 8/2017 | Herndon | F16K 17/406 |

* cited by examiner

*Primary Examiner* — Christopher J Sebesta
*Assistant Examiner* — Lamia Quaim
(74) *Attorney, Agent, or Firm* — Klarquist Sparkman, LLP

(57) ABSTRACT

The present disclosure relates to the technical field of rock mechanics, and in particular to a method for accurately measuring a reopening pressure of hydraulic fracturing induced fracture in a deep borehole. The method includes: pumping a fluid into a sealed inner space of a drilling pipe for energy storage; and opening a valve at a lower end of the drilling pipe such that energy is released from the fluid in the inner space of the drilling pipe under the action of pressure to inject the fluid into a test interval. In the method according to the present disclosure, a fluid is pumped into an inner space of a drilling pipe so that the inner space of the drilling pipe is used as a high-pressure fluid pump to inject the fluid in the inner space of the drilling pipe to the test interval until the closed fracture is reopened.

5 Claims, 3 Drawing Sheets

METHOD FOR ACCURATELY MEASURING REOPENING PRESSURE OF HYDRAULIC FRACTURING INDUCED FRACTURE IN DEEP BOREHOLE

CROSS REFERENCE TO RELATED APPLICATION

The present disclosure claims the priority to the Chinese Patent Application with the filing number 201910304075.1 filed with the Chinese Patent Office on Apr. 16, 2019, entitled "Method for Accurately Measuring Reopening Pressure of Hydraulic Fracturing Induced Fracture in Deep Borehole," the contents of which are incorporated in the present disclosure by reference in its entirety.

TECHNICAL FIELD

The present disclosure relates to the technical field of rock mechanics, and in particular to a method for accurately measuring a reopening pressure of hydraulic fracturing induced fracture in a deep borehole.

BACKGROUND ART

A method for measuring in-situ stress by hydraulic fracturing is currently generally recognized as the most effective technical method for directly measuring in-situ stress in a deep borehole. Due to the advantages that a stress value, in particular a minimum principal stress, can be directly measured with simple operation without rock mechanical parameters, and that the measurement depth is theoretically unlimited, the method for measuring in-situ stress by hydraulic fracturing has been widely used in engineering fields such as hydropower, mines, tunnels, nuclear waste disposal and petroleum strategic storage site selection, as well as the fields such as research on continental dynamics, evaluation of regional crustal stability, and research on seismogenic mechanism, and important social impacts and huge economic benefits are created.

A typical apparatus for the hydraulic fracturing test is designed such that a test zone (generally referred to as a test interval) is sealed and isolated in a borehole with two inflatable packers, and a liquid is injected thereinto using a high-pressure water pump at the ground surface; as the liquid is continuously pumped, the hoop stress state at a location of the borehole wall of the borehole corresponding to the direction of the maximum horizontal principal stress gradually changes from the compressive stress state to the tensile stress state; when its tensile stress value exceeds the tensile strength of rock, the borehole wall starts to be fractured, and the corresponding liquid pressure in this case is referred to as a fracture pressure, which is denoted as $P_b$. If the test interval is again pressurized, the fracture is reopened, and at this time the fracture reopening pressure $P_r$ can be obtained. In this case, if the pumping is stopped and the water pressure loop is kept in a sealed state, an instantaneous shut-in pressure $P_s$ is recorded.

Regarding the calculation and interpretation of the shut-in pressure, it is generally believed in the industry that the calculation and determination of the minimum horizontal principal stress are reliable; in contrast, the calculation and determination of the maximum horizontal principal stress are relatively controversial, and the controversy focuses on the $P_r$ in Formula (1), i.e., the hydraulic fracturing-induced fracture reopening pressure. Many scholars have carried out in-depth discussions and research on this issue. The relevant knowledge about the reopening pressure $P_r$ in the measurement of in-situ stress by hydraulic fracturing may be summarized as follows:

1) The value of the reopening pressure is affected by the compliance of the entire test system. Here, the compliance of the test system is defined as a change in volume of the system caused by a change in unit pressure.

2) The compliance of the test system is mainly affected by the volume of water in the entire test system. For a drilling-pipe-type system for measuring in-situ stress by hydraulic fracturing, the deeper the test depth is, the greater compliance the system has. Taking a 50 mm drilling pipe, which is currently most commonly used in China, as an example, the system compliance will reach $4.52\times10^{-4}$ $m^3$/MPa when the test depth is 840 m.

3) Relevant research results show that the error of the calculated and determined reopening pressure can be controlled within 10% when the compliance of the test system is not greater than or is less than the magnitude level of $5\times10^{-7}$ $m^3$/MPa. To meet such compliance requirements, the depth of the borehole to be measured is generally limited to shallow boreholes of several hundred meters. Once the measurement depth is close to or exceeds one kilometer, the interpretation error of the reopening pressure caused by the excessive compliance of the test system may exceed 100%.

4) The drilling-pipe-type hydraulic fracturing measurement method severely limits the precision of measurement of the in-situ stress in a deep borehole due to its inherent technical characteristics. However, a deeper measurement depth inevitably leads to a significant system compliance, which in turn results in a large error in the induced fracture reopening pressure, which ultimately severely distorts the result of calculation of the maximum horizontal principal stress (see Formula (1)). On this basis, in the technical field of measurement of in-situ stress by hydraulic fracturing, the following basic consensus has been reached: in the case of using the drilling-pipe-type hydraulic fracturing method, when the measurement depth is close to or exceeds a depth of one kilometer, only the measured value of the minimum horizontal principal stress is reliable, and the value of the maximum horizontal principal stress is severely distorted.

It can be seen that for the prior method for measuring in-situ stress by hydraulic fracturing, only after important improvements are made starting with the test process method or key equipment, this measurement technology can be better adapted to the measurement of in-situ stress in a deep borehole to provide reliable data on in-situ stress for related fields. To this end, a lot of explorations and practices have been carried out by scholars and technicians in the related fields. The following representative methods are currently available in the published literatures:

1) A test system equipped with a downhole flowmeter is used. The system has the technical characteristic that a pressure sensor and a flowmeter are integrated into a downhole measurement assembly. The water pump at the ground surface and the downhole measurement assembly are connected by two flexible hydraulic hoses, and the two flexible hydraulic hoses are usually used as a wireline hydraulic fracturing system. After water is injected, the two hoses are used for pressurizing a packer and a test zone, respectively. Since the use of the drilling pipe as a water guiding channel is abandoned in the system, the compliance of the entire test system is significantly reduced. From this point of view, there is a significant effect on the increase of the precision of measurement of the in-situ stress.

However, this system has two most obvious technical defects. Firstly, a drilling pipe is abandoned and a wireline is used in the system, and the rigid connection is changed into a flexible connection manner to lift or lower the downhole measuring equipment and instruments, which significantly increases the risk that the equipment is blocked and stuck in the downhole during the measurement. In the measurement of in-situ stress at a deep location, a wireline-type measurement system should be used with caution. This is also the reason why the drilling-pipe-type measurement system is widely used while the wireline-type measurement system is rarely used in the measurement of the in-situ stress, currently, in China. Secondly, in this measurement system, the downhole measurement assembly should comprise an electromagnetic switch to function as a drilling-pipe-type downhole push-and-pull switch for sealing and unsealing the packer, in addition to the pressure sensor and the flow sensor. In a deep borehole to be measured having a depth of more than one kilometer, the difficulty in integration, as well as reliability, and practicability of the downhole equipment are significantly increased by controlling the operation of the downhole equipment by means of supplying electric power via wires. The above two technical defects are the commonalities present in the wireline-type in-situ stress measurement systems, which severely restrict the popularization and application of such measurement systems in the measurement of in-situ stresses in deep boreholes.

2) In view of the problems existing in the above measurement system, some scholars have proposed another method and process procedure for measuring in-situ stress by hydraulic fracturing, which is called baby borehole hydraulic fracturing method, simply referred to as BABHY. The method is mainly divided into three steps: firstly a baby borehole is drilled in a large borehole, a core is taken therefrom and its integrity is observed, and then the baby borehole is cleaned; then hydraulic fracturing measurement is carried out in the baby borehole, and all the test equipment, including the pressure sensor and the high-pressure water pump, are placed downhole, so that the compliance of the test system is minimized, and the minimum pumping flow rate required by the test system is also minimized, whereby the measurement precision can be greatly improved; and after the hydraulic fracturing is finished, the test system is lifted, and impression and orienting operations are completed to obtain the orientation of a fracture induced by hydraulic fracturing, i.e., the orientation of the maximum horizontal principal stress.

However, the BABHY method is designed too idealistically, and its operational steps are more complicated than conventional hydraulic fracturing tests. In the BABHY method, a single measurement of in-situ stress is divided into multiple steps; in addition, it is necessary to detect the rock core of the baby borehole before the test to determine a test zone that is not affected by natural fracture. In this process, if there is no suitable measurement interval, it is further necessary to expand the hole again and drill the hole deeper to find a next test interval, and it is unknown whether a small hole suitable for the test can be found before each measurement of the in-situ stress, which greatly increases the uncertainty of the experimental result, as well as the time cost and expense cost. This technical method also has a great disadvantage, that is to say, the BABHY method can only obtain the stress state of one test interval in one test, which is very inefficient for the measurement of the in-situ stress in a deep borehole.

SUMMARY

The present disclosure provides a method for accurately measuring a reopening pressure of hydraulic fracturing induced fracture in a deep borehole, the method comprising: pumping a fluid into an inner space of a drilling pipe for energy storage; and opening a valve at a lower end of the drilling pipe such that energy is released from the fluid in the inner space of the drilling pipe under the action of pressure to inject the fluid into a test interval.

BRIEF DESCRIPTION OF DRAWINGS

In order to more clearly illustrate technical solutions of specific embodiments of the present disclosure or of the prior art, drawings required for use in the description of the specific embodiments or the prior art will be described briefly below. It is obvious that the drawings in the following description are illustrative of some embodiments of the present disclosure. It will be understood by those of ordinary skill in the art that other drawings can also be obtained from these drawings without inventive effort.

DETAILED DESCRIPTION OF EMBODIMENTS

The technical solutions of the present disclosure will be described below clearly and completely with reference to the drawings. It is apparent that the embodiments described are some, but not all of the embodiments of the present disclosure. All the other embodiments obtained by those of ordinary skill in the art in light of the embodiments of the present disclosure without inventive effort will fall within the scope of the present disclosure as claimed.

In the description of the present disclosure, it should be noted that orientation or positional relationships indicated by the terms such as "center", "up", "down", "left", "right", "vertical", "horizontal", "inside", and "outside" are the orientation or positional relationships shown based on the drawings, and these terms are intended only to facilitate the description of the present disclosure and simplify the description, but not intended to indicate or imply that the referred apparatuses or elements must be in a particular orientation or constructed or operated in the particular orientation, and therefore should not be construed as limiting the present disclosure.

In addition, the terms "first", "second", and "third" are used for descriptive purpose only, and should not be understood as an indication or implication of relative importance.

In the description of the present disclosure, it should be noted that the terms "mount", "link", and "connect" should be understood broadly unless otherwise expressly specified or defined. For example, connection may be fixed connection or detachable connection or integral connection, may be mechanical connection or electric connection, or may be direct linking or indirect linking via an intermediate medium, or may be internal communication between two elements. The specific meanings of the above-mentioned terms in the present disclosure can be understood by those of ordinary skill in the art according to specific situations.

The present disclosure provides a method for accurately measuring a reopening pressure of hydraulic fracturing induced fracture in a deep borehole, which solve the technical problems existing in the prior art.

Figure 1:
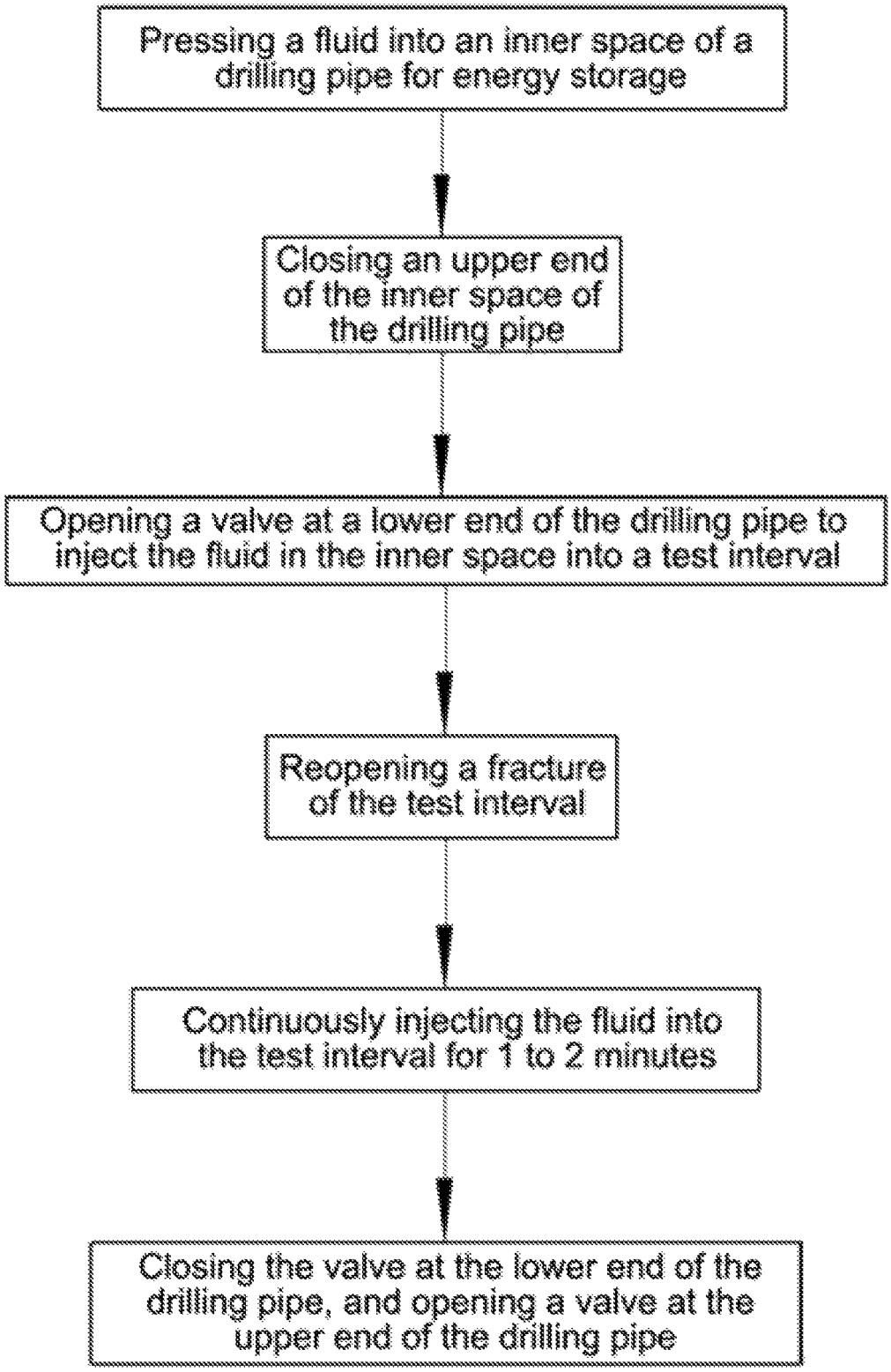
FIG. 1 is a flowchart of a method for accurately measuring a reopening pressure of hydraulic fracturing induced fracture in a deep borehole according to an embodiment of the present disclosure.

As shown in FIG. 1, the present disclosure provides a method for accurately measuring a reopening pressure of hydraulic fracturing induced fracture in a deep borehole, the method comprising:

pumping a fluid into an inner space of a drilling pipe for energy storage; and opening a valve at a lower end of the drilling pipe such that energy is released from the fluid in the inner space of the drilling pipe under the action of pressure to inject the fluid into a test interval.

Further, a flow rate is constant when the fluid is being injected from the inner space of the drilling pipe to the test interval.

Further, a flow rate at which the fluid is injected from the inner space of the drilling pipe to the test interval is greater than a flow rate at which the fluid is seeped into rock mass on a borehole wall of the test interval at the measurement depth.

Further, when the fluid is pumped into the inner space of the drilling pipe, the valve at the lower end of the drilling pipe is kept closed; after the fluid is pumped into the inner space of the drilling pipe to reach a predetermined pressure value, a ground-connected valve is closed, and then the valve at the lower end of the drilling pipe is opened such that the fluid is injected into the test interval.

Further, when the fluid is injected into the test interval, an upground pressure displayed is gradually decreased, and when it is decreased to be equal to or lower than a value of a reopening pressure displayed on a ground pressure gauge in a previous cycle of conventional hydraulic fracturing, the injection of the fluid into the test interval can be stopped.

Further, when a set time period after the injection of the fluid into the test interval is stopped elapses, a ground-connected valve of the drilling pipe is opened to relieve pressure from the entire test interval system.

Further, the set time period is 1 to 2 minutes.

Further, the process, in which the fluid is pumped into the inner space of the drilling pipe and then the fluid is injected into the test interval, is repeated three or more times.

Further, before the fluid is pumped into the inner space of the drilling pipe, at least one cycle of measurement of a reopening pressure by conventional hydraulic fracturing is performed for testing procedures and equipment to provide an overall understanding of the range of the reopening pressure of the fracture.

Further, when the fluid is pumped into the inner space of the drilling pipe, a pressure generated is equal to or greater than 1.5 times the reopening pressure measured by a conventional method.

In the method for accurately measuring a reopening pressure of hydraulic fracturing induced fracture in a deep borehole according to the present disclosure, a fluid is stored into an inner space of a drilling pipe, the drilling pipe is drilled down to a test interval, and the fluid in the inner space of the drilling pipe is released, so that the inner space of the drilling pipe is used as a high-pressure fluid pump to inject the fluid into the test interval to provide a fracture reopening pressure until the fracture is reopened; in this way, the compliance of the test system is minimized during test, which is especially suitable for the measurement of in-situ stress by hydraulic fracturing in a deep borehole, reduces the interference of the value of the fracture reopening pressure from the compliance in the conventional value-taking method, and thus achieves the purpose of measuring the reopening pressure with high precision.

The present disclosure is directed to a new procedure and process for in-situ stress test proposed based on a conventional drilling-pipe-type hydraulic fracturing measuring method, which is directed to a solution proposed mainly to the technical problem that a fracture reopening pressure cannot be accurately measured due to excessive compliance of a system for measuring in-situ stress by hydraulic fracturing in a deep borehole (having a hole depth of generally greater than 800 meters); additionally, regarding the hydraulic fracturing measurement procedures, equipment, and data processing methods involved in the present disclosure, other than those specially indicated, other parts and conventional measurement procedures, equipment and data processing methods are the same as those in the prior art.

Firstly, a fluid is pumped into the inner space of the drilling pipe, that is to say, the fluid is continuously pumped into the inner space of the drilling pipe. When the inner space of the drilling pipe is filled with the fluid, the fluid is continued to be pumped into the inner space of the drilling pipe so that a pressure is generated by the fluid in the inner space of the drilling pipe to form a high-pressure fluid; then an upper end of the inner space of the drilling pipe is closed to avoid flowing of the fluid from the upper end, and the valve at the lower end of the drilling pipe is opened so that the fluid in the inner space of the drilling pipe flows out from the inner space of the drilling pipe. Since the fluid has a higher pressure, a jet flow is formed and enters the test interval, and the fluid continuously flows into the test interval until a fracture in the test interval is reopened.

In this way, when the inner space of the drilling pipe is in downhole, it is equivalent to a new power source, and it is unnecessary to use a high-pressure pump disposed on the ground to introduce a fluid to the test interval via the drilling pipe, whereby the influence caused by excessive compliance of the test system (resulting mainly from the compressibility of the fluid in the inner space of the drilling pipe) when the high-pressure pump is introducing the fluid to the test interval is avoided, the accuracy of the test results is ensured, and the measurement precision is improved.

In the present embodiment, in order to be able to facilitate recording and measurement of the pressure when the fracture of the test interval is reopened, when the fluid is injected from the inner space of the drilling pipe to the test interval, the output flow rate is made constant so as to facilitate accurate determination of the reopening pressure.

Specifically, in the present embodiment, a flow control valve is disposed at the output end of the inner space of the drilling pipe, and the control of the magnitude of the flow rate is achieved by the flow control valve to ensure the same flow rate of the fluid when being output.

More specifically, in the present embodiment, the flow rate at which the fluid is injected from the inner space of the drilling pipe to the test interval is less than the flow rate at which the fluid is pumped into the inner space of the drilling pipe.

In other words, when the fluid is being injected from the inner space of the drilling pipe to the test interval, the fluid needs to be injected slowly and stably to ensure that the pressure value when the fracture of the test interval is reopened can be recorded in time; and when the fluid is injected into the inner space of the drilling pipe, there is no need to take accurate recording and measurement into consideration, as long as the introduction of a high pressure into the inner space of the drilling pipe can be quickly achieved to ensure that the fracture of the test interval can be reopened by the fluid in the inner space of the drilling pipe.

In the present embodiment, the flow rate at which the fluid is injected from the inner space of the drilling pipe to the test interval is greater than a flow rate at which the fluid is seeped into the rock mass on the borehole wall of the test interval at the measurement depth.

With such an arrangement, when the fluid is injected from the inner space of the drilling pipe to the test interval, the fluid can form a pressure in the borehole of the test interval so as to ensure reopening of the fracture of the borehole wall.

In the present embodiment, after the fluid is pumped into the inner space of the drilling pipe, a ground-connected valve of the drilling pipe is closed, and then the valve at the lower end of the drilling pipe is opened to inject the fluid into the test interval. In other words, the fluid is firstly pumped into the inner space of the drilling pipe by the high-pressure pump; when a predetermined pressure value is reached, the upper end of the inner space is closed to avoid flowing of the fluid from the upper end, and then the valve at the lower end of the drilling pipe is opened such that the inner space of the drilling pipe communicates with the test interval, whereby the fluid can be injected into the test interval to ensure that the fluid can be introduced into the test interval in time and effectively, and ultimately the accuracy and precision of the final result of the measurement are ensured.

Specifically, in the present embodiment, the predetermined pressure value is generally about 1.5 times the reopening pressure value obtained by a conventional hydraulic fracturing reopening cycle.

Further, when the fluid is injected into the test interval, an upground pressure displayed is gradually decreased, and when it is decreased to be equal to or lower than a value of a reopening pressure displayed on a ground pressure gauge in a previous cycle of conventional hydraulic fracturing, the injection of the fluid into the test interval can be stopped.

Specifically, when the upground pressure value currently displayed is gradually decreased to a numerical value decreased to be equal to or lower than the upground pressure value displayed when the fracture is reopened in the previous test, the fracture of the test interval is in a reopened state. In this case, the flow control valve at the output end of the inner space of the drilling pipe is closed to avoid a change in fracture caused by the continuous injection of the fluid, thereby ensuring the accuracy of measurement of the reopened fracture so as to ensure the accuracy and precision of the final calculation of the reopening pressure.

Further, when a set time period after the injection of the fluid to the test interval is stopped elapses, the ground-connected valve is opened to relieve pressure from the entire test interval system.

Specifically, in the present embodiment, the set time period in which the pressure in the inner space of the drilling pipe is stabilized is 1 to 2 minutes.

It should be noted that, in the present embodiment, the set time period is 1 to 2 minutes, but it is not only limited to 1 to 2 minutes, and may be specifically determined according to parameters such as capacity, shape, and volume of the inner space of the drilling pipe, it may be a longer time period, such as 3 minutes or 5 minutes, or it may also be a shorter time period, such as 30 seconds or the like. In other words, as long as the pressure in the inner space of the drilling pipe can be stabilized, a filling inlet of the inner space of the drilling pipe can be opened to discharge the fluid from the filling inlet to relieve pressure from the inner space of the drilling pipe.

In order to ensure the accuracy of the test, in the present embodiment, the entire test process, in which the fluid is pumped into the inner space of the drilling pipe and then the fluid is injected into the test interval, is repeated three or more times.

Additionally, in order to further ensure the accuracy of the test, in the present embodiment, before the fluid is pumped into the inner space of the drilling pipe, at least one cycle of measurement is performed by using a conventional method for testing procedures and equipment, and the range of measured values of the reopening pressure is preliminarily delimited.

In the present disclosure, the fluid is specifically water.

It should be noted that, in the present embodiment, the fluid is water, but it is not only limited to water, and it may also be a liquid such as oil, or may be a fluid such as mud. In other words, it is enough as long as the fluid can be injected into the inner space of the drilling pipe and form a high pressure, and then can be ejected from the inner space of the drilling pipe using the high pressure to form a tension on the test interval.

In summary, the method for measuring a hydraulic fracturing-induced fracture reopening pressure in a deep borehole in the present disclosure is specifically performed by the following steps:

Each test interval consists of five cycles. The test procedures, equipment, data processing in the first cycle and the second cycle are completely the same as those in the conventional hydraulic fracturing method; and the fracture reopening testing test is performed by the method proposed in the present disclosure from the third cycle to the fifth cycle.

Figure 2:
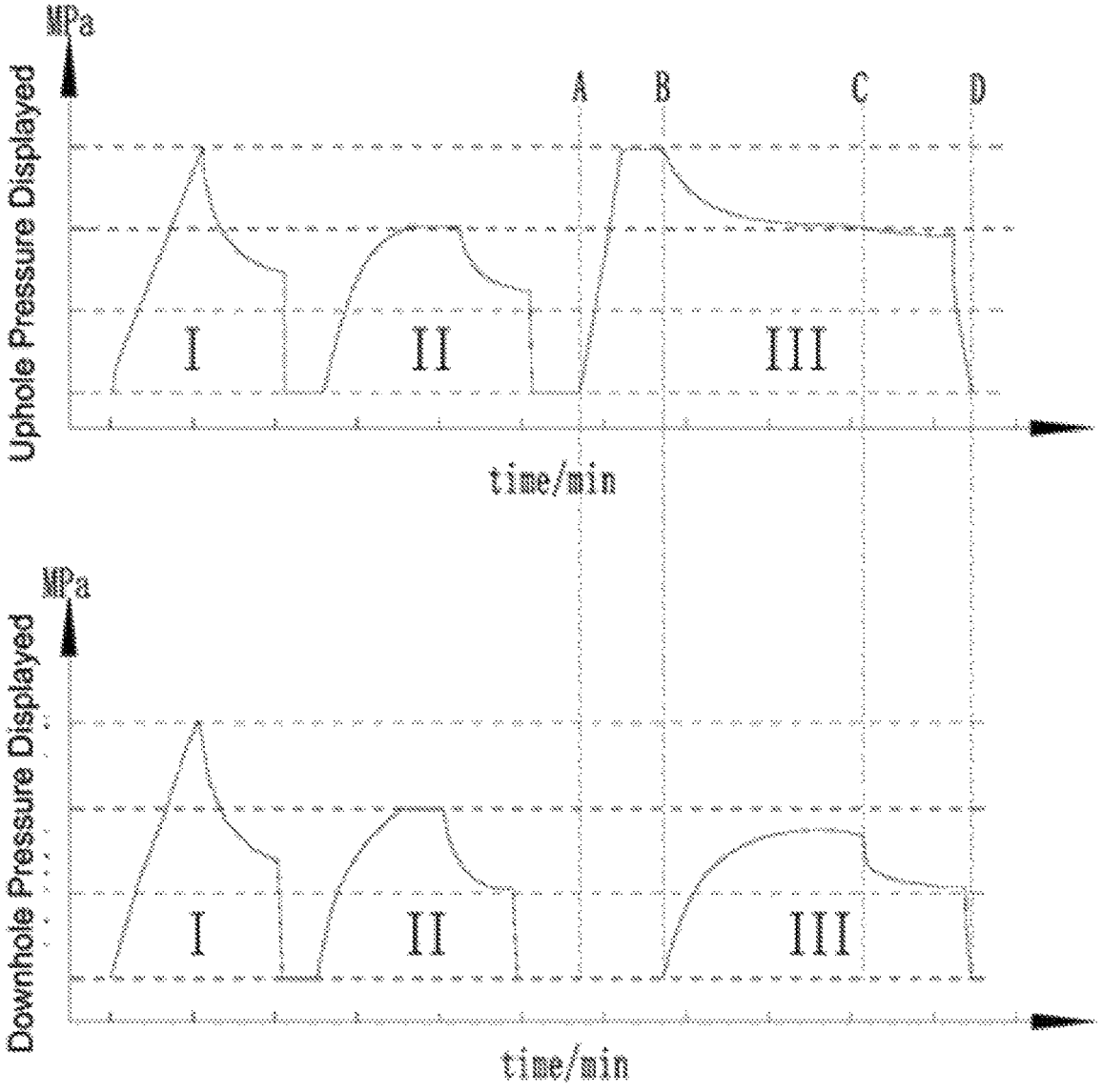
FIG. 2 shows a ground pressure record and a downhole pressure record during measurement of a hydraulic fracturing-induced fracture reopening pressure in a deep borehole according to an embodiment of the present disclosure.
Figure 3:
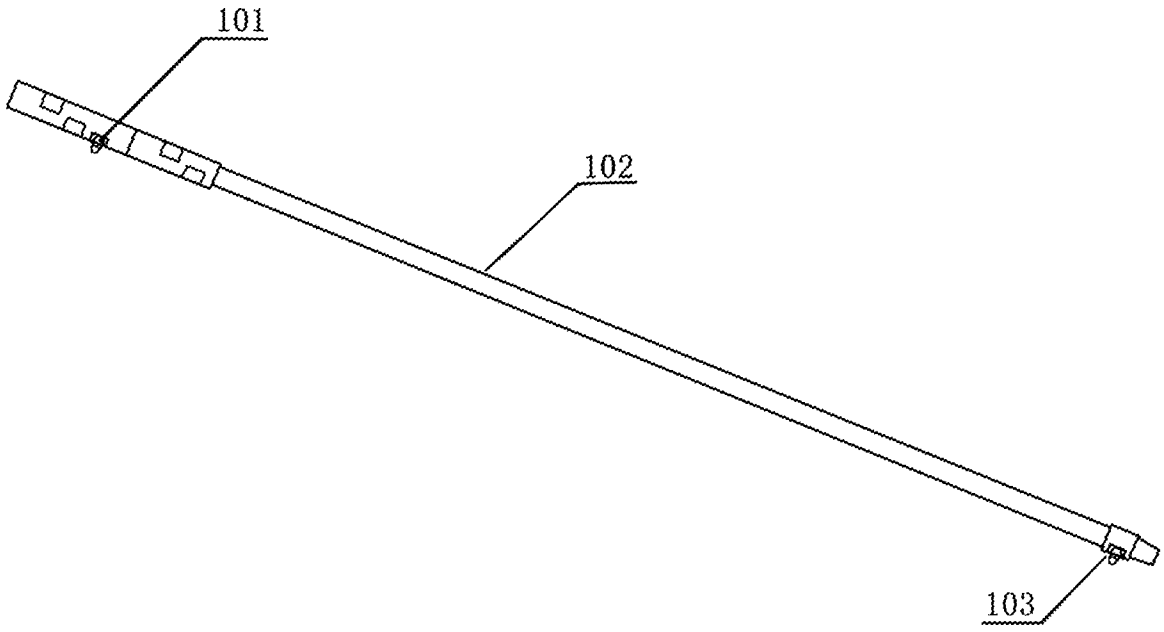
FIG. 3 shows a drilling pipe 102, provided with ground-connected valve 101 and valve at a lower end of the drilling pipe 103.

The reopening testing test is performed by the following process:

1. After the second cycle of measurement process is finished, downhole shut-in is carried out (corresponding to time A in FIG. 2) by using a downhole multi-functional change-over switch in the method of the present disclosure such that the drilling pipe is isolated from the jumper packer and the test interval, and in this case an independent sealed system is formed by the drilling pipe together with an overground high-pressure manifold and a high-pressure water pump. Subsequently, water is injected into the drilling pipe by the high-pressure water pump for pressurization until the pressure reaches or exceeds a peak pressure in the first cycle, or reaches at least 1.5 times the reopening pressure measured by the conventional method, and then the high-pressure pump is turned off and the downhole shut-in state is maintained. The purpose of this operation is to make use of the compression characteristic of water to use high-pressure water in the drilling pipe as an energy storage power source.

2. The downhole shut-in is released (corresponding to time B in FIG. 2) by lifting and lowering operations performed by an overground drilling rig, so that the drilling pipe system in which high-pressure water is stored communicates with the test interval via a constant low flow controller, and in this case, the function of the drilling pipe system in which high-pressure water is stored together with the flow controller is substantially equivalent to a low flow high-pressure water pump placed immediately adjacent to the upper portion of the downhole test interval, and then the fluid is injected into the test interval at a substantially constant flow rate until the fracture is reopened (corresponding to time C in FIG. 2); second downhole shut-in is implemented, and after 1 to 2 minutes, the downhole shut-in is released again and a valve for the overground high-pressure manifold is opened, so that the entire test system communicates with the atmosphere for pressure relief (corresponding to time D in FIG. 2). At this point, the third cycle of experiment is finished. Here, the purpose of implementing the second downhole shut-in is to naturally close the fracture of the test interval without interference from an external pressure source, and a shut-in pressure value obtained at this time is also the most reliable.

3. Hydraulic fracturing fracture reopening experiments in the fourth and fifth cycles are executed repeatedly in accordance with the operation procedures in the third cycle.

4. The value of the fracture pressure is taken by the same method as before, the peak pressure in the first cycle is taken as the fracture pressure. The reopening pressure is determined by the values taken in the third, fourth, and fifth cycles, and the value of the shut-in pressure is comprehensively calculated from the values in the second to fifth cycles.

In the method for accurately measuring a reopening pressure of hydraulic fracturing induced fracture in a deep borehole according to the present disclosure, a fluid is stored into an inner space of a drilling pipe, the drilling pipe is drilled down to a test interval, and the fluid in the inner space of the drilling pipe is released, so that the inner space of the drilling pipe is used as a high-pressure fluid pump to inject the fluid into the test interval to provide a fracture reopening pressure until the fracture is reopened; in this way, the compliance of the test system is minimized during test, which is especially suitable for the measurement of in-situ stress by hydraulic fracturing in a deep borehole, reduces the interference of the value of the fracture reopening pressure from the compliance in the conventional value-taking method, and thus achieves the purpose of measuring the reopening pressure with high precision.

Finally, it should be noted that the above embodiments are merely intended to illustrate the technical solutions of the present disclosure, but not intended to limit the present disclosure. Although the present disclosure has been described in detail with reference to the foregoing embodiments, it should be understood by those of ordinary skill in the art that the technical solutions disclosed in the foregoing embodiments may still be modified, or some or all of the technical features thereof may be replaced with equivalents; and these modifications or replacements will not cause the essence of the corresponding technical solutions to depart from the scope of the technical solutions of the embodiments of the present disclosure.

In addition, it can be understood by those skilled in the art that while some embodiments herein include some but not other features included in other embodiments, combinations of features of different embodiments are meant to be within the scope of the present disclosure, and form different embodiments. For example, in the above embodiments, any one of the claimed embodiments can be used in any combination manner. Information disclosed in the Background Art section is only intended to facilitate understanding of the overall background art of the present disclosure, and shall not be deemed as admitting or implying in any form that the information constitutes the prior art well known to those skilled in the art.

We claim:

1. A method for accurately measuring a reopening pressure of hydraulic fracturing induced fracture in a deep borehole, characterized in that the method comprises:

pumping a fluid into an inner space of a drilling pipe, wherein a valve at a lower end of the drilling pipe is closed, and after the fluid is pumped into the inner space of the drilling pipe to reach a predetermined pressure, a ground-connected valve is closed;

opening the valve at the lower end of the drilling pipe such that the fluid in the inner space of the drilling pipe is injected into a test interval under an action of pressure; and measuring a pressure of the fluid when the fracture is reopened.

2. The method for accurately measuring a reopening pressure of hydraulic fracturing induced fracture in a deep borehole according to claim 1, wherein a flow rate is constant when the fluid is injected from the inner space of the drilling pipe to the test interval.

3. The method for accurately measuring a reopening pressure of hydraulic fracturing induced fracture in a deep borehole according to claim 1, wherein when a set time period after the injection of the fluid into the test interval is stopped elapses, the ground-connected valve of the drilling pipe is opened to relieve pressure from an entire test interval system.

4. The method for accurately measuring a reopening pressure of hydraulic fracturing induced fracture in a deep borehole according to claim 3, wherein the set time period is 1 to 2 minutes.

5. The method for accurately measuring a reopening pressure of hydraulic fracturing induced fracture in a deep borehole according to claim 1, wherein the process, in which the fluid is pumped into the inner space of the drilling pipe and then the fluid is injected into the test interval, is repeated three or more times.

* * * * *